US009618300B2

(12) United States Patent
Walker

(10) Patent No.: US 9,618,300 B2
(45) Date of Patent: Apr. 11, 2017

(54) RIFLE SCOPE HANDWHEEL KIT

(71) Applicant: Deben Group Industries Limited, Melton, Woodbridge (GB)

(72) Inventor: Stephen Andrew Walker, Woodbridge (GB)

(73) Assignee: Deben Group Industries Limited, Melton, Woodbridge (GB)

( * ) Notice: Subject to any disclaimer, the term of this patent is extended or adjusted under 35 U.S.C. 154(b) by 0 days.

(21) Appl. No.: 15/213,815

(22) Filed: Jul. 19, 2016

(65) Prior Publication Data

US 2016/0327364 A1 Nov. 10, 2016

Related U.S. Application Data

(62) Division of application No. 14/547,438, filed on Nov. 19, 2014, now Pat. No. 9,429,391.

(30) Foreign Application Priority Data

Nov. 19, 2013 (GB) ..... 1320436.7

(51) Int. Cl.
*F41G 1/38* (2006.01)
*F41G 1/16* (2006.01)
*G05G 1/12* (2006.01)

(52) U.S. Cl.
CPC ..... *F41G 1/16* (2013.01); *F41G 1/38* (2013.01); *G05G 1/12* (2013.01); *Y10T 74/2084* (2015.01)

(58) Field of Classification Search
CPC .... F41G 1/38; F41G 1/16; F41G 1/26; G05G 1/12; Y10T 74/2084
USPC ..... 42/111, 119, 122, 123, 125, 126, 130
See application file for complete search history.

(56) References Cited

U.S. PATENT DOCUMENTS 3,990,155 A * 11/1976 Akin, Jr. ..... F41G 1/38 42/122
4,247,161 A 1/1981 Unertl, Jr.
4,920,679 A * 5/1990 Sarles ..... F41A 21/481 42/75.02

(Continued)

FOREIGN PATENT DOCUMENTS

GB 2512915 10/2014

OTHER PUBLICATIONS

GB Search Report bearing a mailing date of Sep. 4, 2014 from a corresponding GB patent application, 2 pages.

(Continued)

*Primary Examiner* — John D Cooper
(74) *Attorney, Agent, or Firm* — Burr & Brown, PLLC

(57) ABSTRACT

A kit for fitting a handwheel to a focussing control of a rifle scope is used to enlarge a focussing ring of the control, without having to remove the focussing ring from the control. The handwheel is secured by a headed bolt to a projecting stub shaft. The handwheel has a side plate supporting an outer rim that has a plurality of peripheral indentations to assist turning of the handwheel. The side plate has a central hole and a hub that projects axially from the side plate and defines a bore for receiving the stub shaft. The outer diameter of the hub is received within an outer end portion of the focussing ring. The hub has at least one abutment that co-operates with the stub shaft to inhibit relative rotational movement. A cap bolt extends through the hole to engage the stub shaft and secure the handwheel to the control.

15 Claims, 8 Drawing Sheets

(56) References Cited

U.S. PATENT DOCUMENTS

| | | | | |
|---|---|---|---|---|
| 5,697,689 | A | 12/1997 | Levine et al. | |
| 6,279,259 | B1 | 8/2001 | Otteman | |
| 7,997,163 | B2 | 8/2011 | Casas | |
| 8,166,697 | B1 * | 5/2012 | Sueskind | F41G 1/38 42/119 |
| 8,919,026 | B2 | 12/2014 | Hamilton | |
| 2006/0150370 | A1 | 7/2006 | Farmer | |
| 2007/0137089 | A1 | 6/2007 | William, III et al. | |
| 2012/0186131 | A1 * | 7/2012 | Windauer | F41G 1/38 42/122 |

OTHER PUBLICATIONS

UK Search Report from a corresponding UK patent application bearing a mailing date of May 18, 2015, 1 page.

* cited by examiner

RIFLE SCOPE HANDWHEEL KIT

CROSS REFERENCE TO RELATED APPLICATION

This application is a division of U.S. application Ser. No. 14/547,438 filed Nov. 19, 2014 and claims the benefit of GB Application 1320436.7, filed Nov. 19, 2013, the entireties of which are incorporated herein by reference.

BACKGROUND a. Field of the Invention

This invention relates to a handwheel and a handwheel kit for enlarging a focussing ring of a rifle scope. In particular, the invention relates to a handwheel kit for fitting to a rifle scope focussing control to provide the rifle scope with a relatively large diameter handwheel for use as a focussing ring for adjusting the focus of the scope, as compared to a relatively small diameter focussing ring as originally provided on the rifle scope as manufactured. The invention further relates to a method of fitting such a relatively large handwheel to a rifle scope to provide an enlarged focussing ring.

b. Related Art

Many known designs of rifle scope (hereinafter referred to simply as a "scope") include a focussing control comprising a relatively small diameter focussing ring furnished on a stub shaft projecting laterally from the barrel of the scope, the stub shaft being connected internally within the barrel to movable lens components for effecting adjustment of the scope focus. in this application, the term "relatively small" means a diameter less than the diameter of any part of the barrel of the scope. In optimum conditions, such a focussing ring may be sufficient to allow accurate focussing, but in more difficult conditions, such as in a cold climate, many users find the focussing ring too small to give the accurate focussing that the user requires.

In view of the above, it is known to exchange the focussing ring with a handwheel of a larger diameter by releasing the focussing ring from the scope and then fitting the larger diameter handwheel to the stub shaft projecting from the scope barrel. However, there is often a seal provided on the focussing ring to prevent the ingress of moisture into the scope barrel and if the focussing ring is removed, that seal may be lost. Moreover, there may be a friction arrangement between the focussing ring and the scope barrel, in order to give an appropriate "feel" to the focussing control. As such, the removal and discarding of the focussing ring is in general not recommended by scope manufacturers.

An alternative approach has been to provide a relatively large diameter handwheel having a hub with a central bore which is appropriately sized to fit over the outer surface of the scope focussing ring. The handwheel is then secured in position by means of three or more grub screws threaded into equally spaced radial bores provided through the hub wall, for engagement with the outer surface of the focussing ring. Typically, such grub screws have hexagonal sockets at one end to allow the turning thereof by means of an Allen key. Though in theory this solution would seem more appropriate, in that it does not disturb the arrangement of the focussing ring, in practice the engagement of the grub screws with the outer surface of the focussing ring may cause significant damage to that focussing ring if the handwheel is to be secured sufficiently firmly on tightening the grub screws. Moreover, the use of an Allen key to drive the grub screws can be very difficult in the confined region of the handwheel when fitted to the scope, and it is all too easy to lose one of the small grub screws.

It is a principal aim of the present invention to provide means whereby a relatively large handwheel may be fitted to a rifle scope without suffering the disadvantages discussed above of the known arrangements for achieving this.

SUMMARY OF THE INVENTION

Described herein is a rifle scope apparatus comprising a handwheel kit for enlarging a focussing ring of a rifle scope, and a rifle scope comprising said focussing ring, said apparatus including either one or two headed bolts each with a head and a threaded portion, wherein:

a) the rifle scope comprises a main barrel and a focussing adjustment control the focussing adjustment control extending laterally away from a side of the main barrel of the rifle scope, and the focussing adjustment control comprising:
   - a focussing ring manually accessible on said side of the main barrel, said focussing ring having a rotation axis and being manually rotatable about the rotation axis to effect a focussing adjustment of the rifle scope;
   - a stub shaft within the focussing ring and projecting laterally from said side of the main barrel towards a free end of the stub shaft, the stub shaft being rotationally fixed with respect to the focussing ring such a rotation of the focussing ring causes a corresponding rotation of the stub shaft, and the stub shaft having in the free end of the stub shaft a threaded axial bore;
   - a bore between the focussing ring and the stub shaft at the free end of the stub shaft; and
   - one of said headed bolts, the configuration of said headed bolt, stub shaft and focussing ring being such that:
     - (i) the threaded portion of said headed bolt is removably engageable with the threaded axial bore, and the focussing ring is held to the stub shaft by the head of said headed bolt when the threaded portion of said headed bolt is engaged with the axial bore; and
     - (ii) the bore between the focussing ring and the stub shaft is exposed when the headed bolt is disengaged from the threaded axial bore;

b) the handwheel kit comprises a handwheel and a cap bolt, the handwheel comprising:
   - an outer rim having an outer periphery for providing said enlarged focussing ring, the outer periphery of the outer rim comprising a plurality of peripheral indentations for assisting manual turning of the handwheel about a rotational axis of the handwheel when the handwheel is fitted to said focussing ring;
   - a side plate, the side plate supporting the outer rim and extending radially inwards from the outer rim towards a central hole in the side plate, the side plate having opposite first and second sides; and
   - a hub, the hub projecting axially away from the second side of the side plate to present a bore within the hub, said hole extending to said bore within the hub and the hub being concentric with said hole about said rotational axis and the hub of the handwheel being configured to be received in said exposed bore between the focussing ring and the stub shaft; and said cap bolt is either the same headed bolt when removed from the threaded axial bore of the stub shaft or is a second one of said headed bolts, the threaded portion of the cap bolt being configured to extend through the central hole in the side plate and with said hub received in said exposed bore, to screw into the threaded axial bore of the stub shaft until the head of the cap bolt bears on the first side of the side plate opposed to the hub to secure the handwheel to the stub shaft, the handwheel thereby providing an enlarged focussing ring for the focussing adjustment control.

According to a first aspect of this invention there is provided a focussing handwheel kit for enlarging a focussing ring of a rifle scope, said kit comprising a handwheel for fitting to a stub shaft of said focussing ring and a cap bolt for securing the handwheel to said stub shaft, in which the handwheel comprises:

an outer rim having an outer periphery for providing said enlarged focussing ring, the outer periphery of the outer rim comprising a plurality of peripheral indentations for assisting manual turning of the handwheel about a rotational axis of the handwheel when the handwheel is fitted to said focussing ring;

a side plate, the side plate supporting the outer rim and extending radially inwards from the outer rim towards a central hole in the side plate, the side plate having opposite first and second sides; and a hub, the hub projecting axially away from the second side of the side plate to present a bore within the hub for receiving said stub shaft, said hole extending to said bore and the hub being concentric with said hole about said rotational axis;

wherein the cap bolt has a head and a threaded portion, the threaded portion being configured to extend through said hole such that said threaded portion, in use, screws into a threaded bore of said stub shaft received in said hub, and the head being configured to bear on the first side of the side plate opposed to the hub when the threaded portion of the cap bolt is screwed into said threaded bore to secure the handwheel to said stub shaft, and the hub has at least one abutment in the bore within the hub for co-operation with said stub shaft to inhibit relative rotational movement between the handwheel and said stub shaft when the handwheel is secured to said stub shaft by the cap bolt, and the second side of the side plate has an annular planar portion surrounding the hub for covering a free end of said focussing ring when the handwheel is secured to said stub shaft by the cap bolt.

According to a second aspect of this invention there is provided a focussing handwheel for fitting to a stub shaft of a focussing ring of a rifle scope to provide an enlarged focussing ring for the rifle scope, the handwheel comprising:

an outer rim having an outer periphery for providing said enlarged focussing ring, the outer periphery of the outer rim comprising a plurality of peripheral indentations for assisting manual turning of the handwheel about a rotational axis of the handwheel when the handwheel is fitted to said focussing ring;

a side plate, the side plate supporting the outer rim and extending radially inwards from the outer rim towards a central hole in the side plate, the side plate having opposite first and second sides; and a hub, the hub projecting axially away from the second side of the side plate to present a bore within the hub for receiving said stub shaft, said hole extending to said bore within the hub and the hub being concentric with said hole about said rotational axis;

wherein said hole leads to said bore within the hub to allow a threaded shaft of a cap bolt to pass through said hole and into said bore for engagement with a threaded bore in said stub shaft and the hub has at least one abutment in the bore within the hub for co-operation with said stub shaft to inhibit relative rotational movement between the handwheel and said stub shaft when the handwheel is secured to said stub shaft by the cap bolt, and the second side of the side plate has an annular planar portion surrounding the hub for covering a free end of said focussing ring when the handwheel is secured to said stub shaft by the cap bolt.

According to a third aspect of this invention there is provided a method of enlarging the focussing ring of a focussing control of a rifle scope using a focussing handwheel comprising a periphery larger than that of said focussing ring, a side plate with a central hole, the central hole extending to a hub having a hub bore, and the focussing control having: a focussing ring that is manually accessible on said side of the scope, said focussing ring having a rotation axis for adjusting the focus of the scope; a stub shaft within the focussing ring, the stub shaft being rotationally fixed with respect to the focussing ring such a rotation of the focussing ring causes a corresponding rotation of the stub shaft, and the stub shaft having in a free end of the stub shaft a threaded axial bore; and a headed bolt with a head and a threaded bore removably engaged with said threaded bore such that a head of the cap bolt retains the focussing ring, wherein the method comprises:

removing the headed bolt from the stub shaft;

with the focussing ring in place, fitting the handwheel to the rifle scope by engaging a bore in a hub of the handwheel with a free end portion of the stub shaft;

passing the threaded portion of a cap bolt through the central hole in the side plate and engaging the threaded portion with the threaded bore in the stub shaft; and tightening the cap bolt sufficiently to engage the side plate with the focussing ring thereby holding the focussing handwheel to the rifle scope such that the periphery of the focussing handwheel provides an enlarged focussing ring for a user of the rifle scope.

It will be appreciated that the handwheel kit of this invention (i.e. the handwheel and associated cap bolt) allows the scope to retain its original relatively small diameter focussing ring when fitting a relatively large diameter focussing handwheel to the stub shaft of the focussing mechanism of the scope, but the kit does not in any way damage the outer surface of the focussing ring and moreover the accurate location of the handwheel in a true radial plane can be assured. This is achieved by removing the original headed bolt threaded to the stub shaft and holding the focussing ring on that shaft, and then fitting the handwheel to that shaft to abut the outer face of the focussing ring, whereafter either the same headed bolt or an additional cap bolt is used axially to clamp the handwheel to the focussing ring. In the event that the handwheel is no longer required, the cap bolt may be removed followed by removal of the handwheel. Then, on fitting the cap bolt to the stub shaft, the original arrangement is restored with no damage to the focussing ring.

The handwheel may be any type of wheel having an outer periphery having indentations that may be gripped and turned by hand. Most usually, the handwheel will be substantially disc-shaped, having a generally circular and indented outer periphery that is concentric with an axis of the handwheel.

It is important that the handwheel is held against relative rotation with respect to the stub shaft, in order that focussing may take place by turning the handwheel. For this purpose, the focussing ring is held to the stub shaft such that the focussing ring and stub shaft rotate in unison. The hub of the handwheel also has at least one abutment for co-operation with a recess in the stub shaft. Typically, the stub shaft will have at least one recess, which may be an axially extending keyway. Preferably, there is more than one such recess, for example two or three keyways with unequal circumferential spacing. The hub of the handwheel should have a similar number of projections as there are keyways in the stub shaft, with the angular disposition of those projections corresponding to that of the keyways, such that the handwheel may be fitted to the stub shaft in only one orientation. The projections conveniently may take the form of ribs extending parallel to the stub shaft axis.

In order to give accurate location of the handwheel on the stub shaft, the hub should have a circular bore (apart from the projections themselves). Preferably, the bore is a close sliding fit on the stub shaft. Further, it is preferred for the outer surface of the hub to be a close sliding fit into the bore of the focussing ring. In this way, when the cap bolt is tightened, the handwheel will be concentrically located on the stub shaft and lying in a true radial plane.

Preferably, the cap bolt has a circular head of a significantly lesser thickness than the diameter of the cap bolt. The outer surface of the head may be domed to some extent in order to give the cap bolt an attractive appearance while still having sufficient strength for clamping the handwheel to the stub shaft. Openings may be provided in the head of the cap bolt for engagement by projections provided on a key for turning the cap bolt, the arrangement of the projections being the same as that of the openings. For some arrangements, it may be possible to re-use the headed bolt originally associated with the focussing ring, instead of providing an additional cap bolt as part of the handwheel kit.

In order to allow a compact arrangement despite the retention of the focussing ring and the location of the side plate of the handwheel against the focussing ring, it is preferred for the handwheel to have an outer rim disposed wholly to one side of the side plate, such that the rim projects towards the scope when the handwheel has been fitted to the scope.

This invention extends to both a relatively large diameter focussing handwheel by itself and to a method of mounting the handwheel on a scope in the manner described above, using a suitable headed bolt for threading into the stub shaft of the scope, to secure the handwheel on the stub shaft.

BRIEF DESCRIPTION OF THE DRAWINGS

By way of example only, one specific embodiment of handwheel kit of this invention for use with a rifle scope and a method of using the kit with a rifle scope will now be described in detail, reference being made to the accompanying drawings in which.

DETAILED DESCRIPTION

Figure 1:
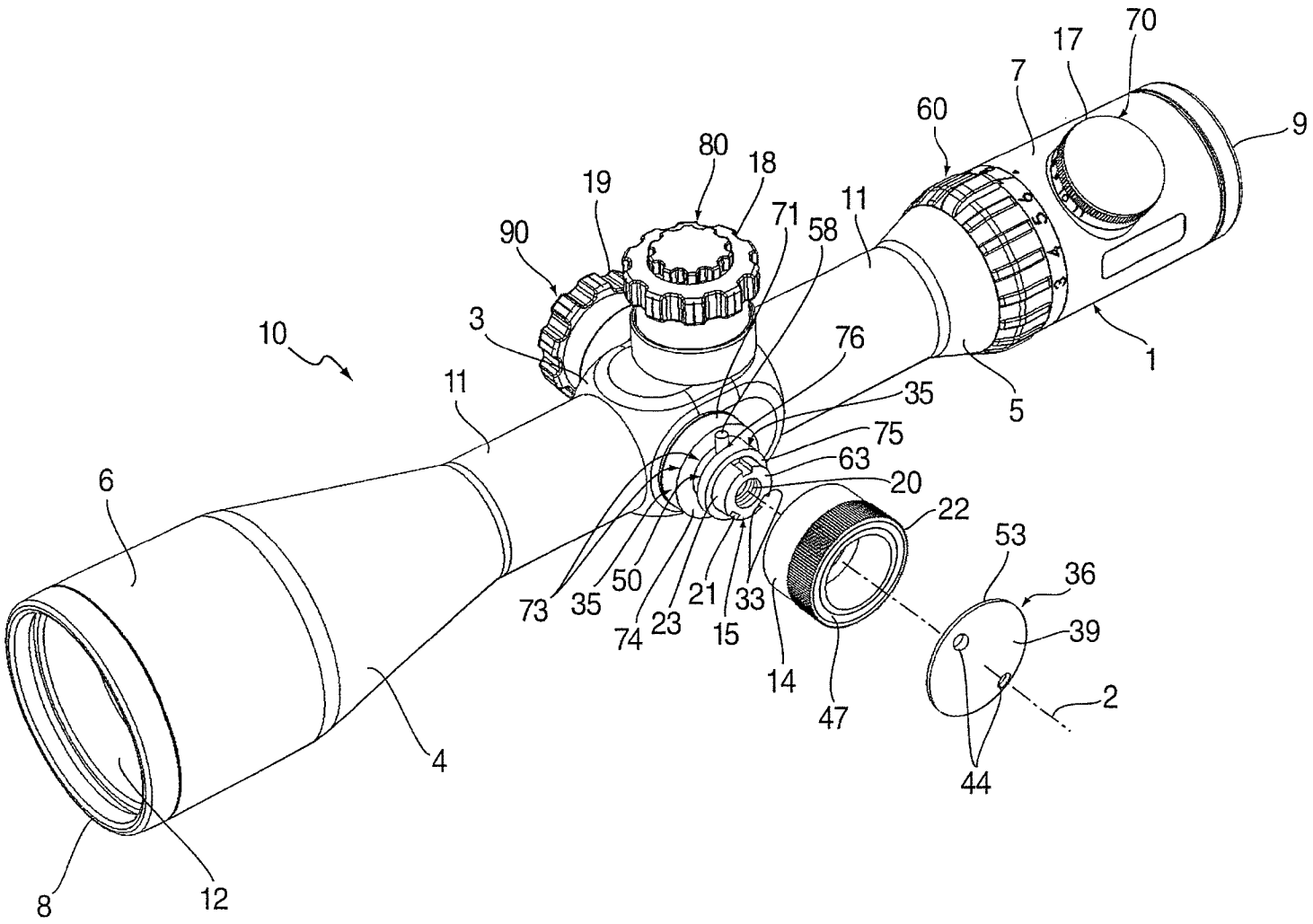
FIGS. 1 and 2 are isometric views of a rifle scope having a main barrel showing a focussing control partly disassembled with a focussing ring mounted on a side of the barrel by a removable cap bolt, for use with handwheel for providing a focussing ring with an enlarged diameter, in a preferred embodiment of the invention.

In the drawings, there is shown a zoom rifle scope 10 (referred to in this description simply as a "scope") having a main barrel 1. The main barrel 1 has a substantially cylindrical central portion 11 with a centrally located part-spherical or rounded housing 3 for sighting adjustment mechanisms and that is flanked by two outwardly taping conical portions 4, 5. One barrel conical portion 4 leads to a first substantially cylindrical end portion 6 that supports an objective lens 12 and the other barrel conical portion 5 leads to a second substantially cylindrical end portion 7 that supports an eyepiece lens 13, these lenses 12, 13 being at opposite first and second ends 8, 9 of the barrel.

Figure 3:
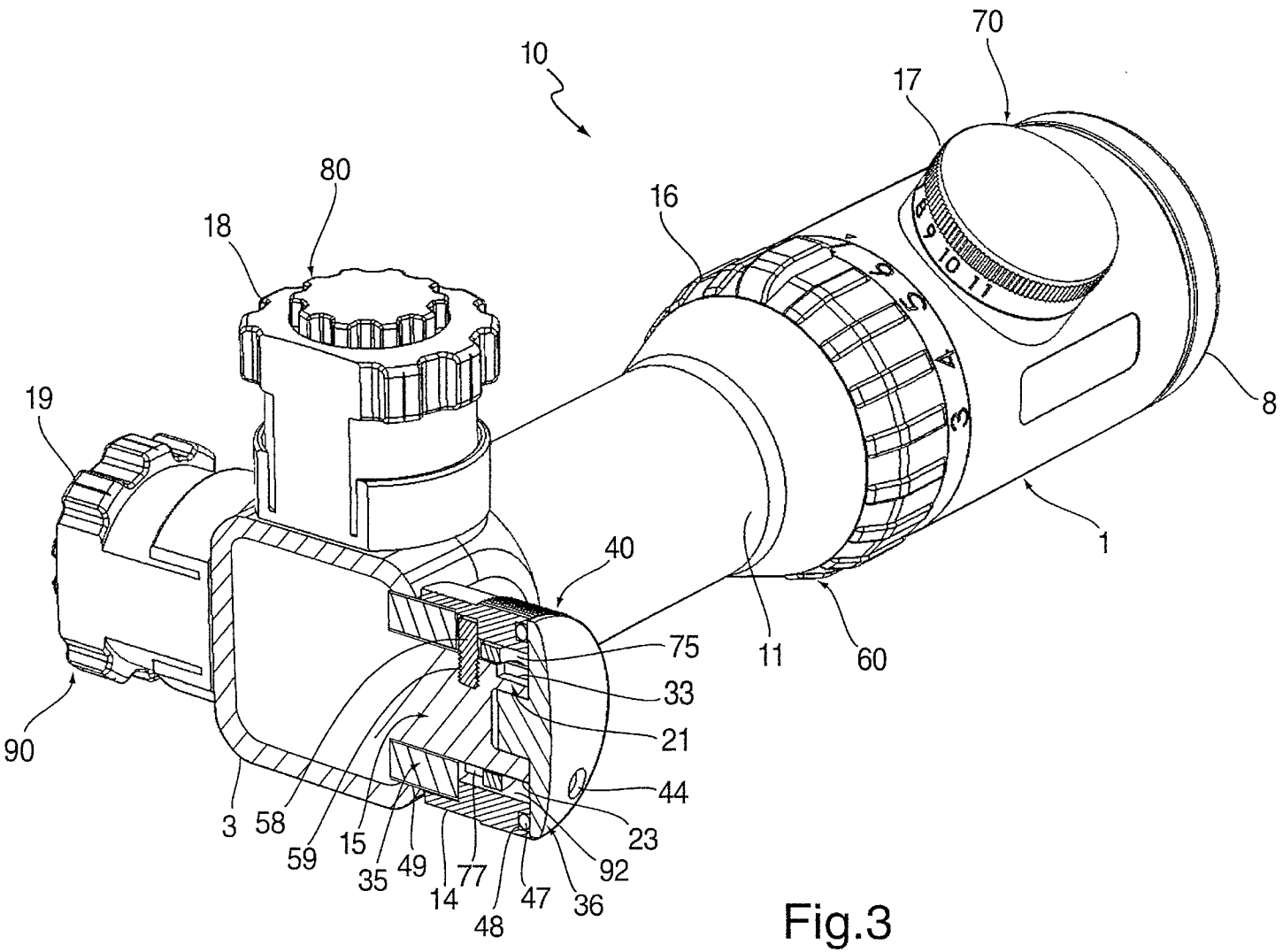
FIG. 3 shows the rifle scope of FIG. 1 with the focussing control assembled, in a view that is cut through along a plane that is perpendicular to a longitudinal axis of the main barrel and that passes through the centre of the focussing control.
Figure 4:
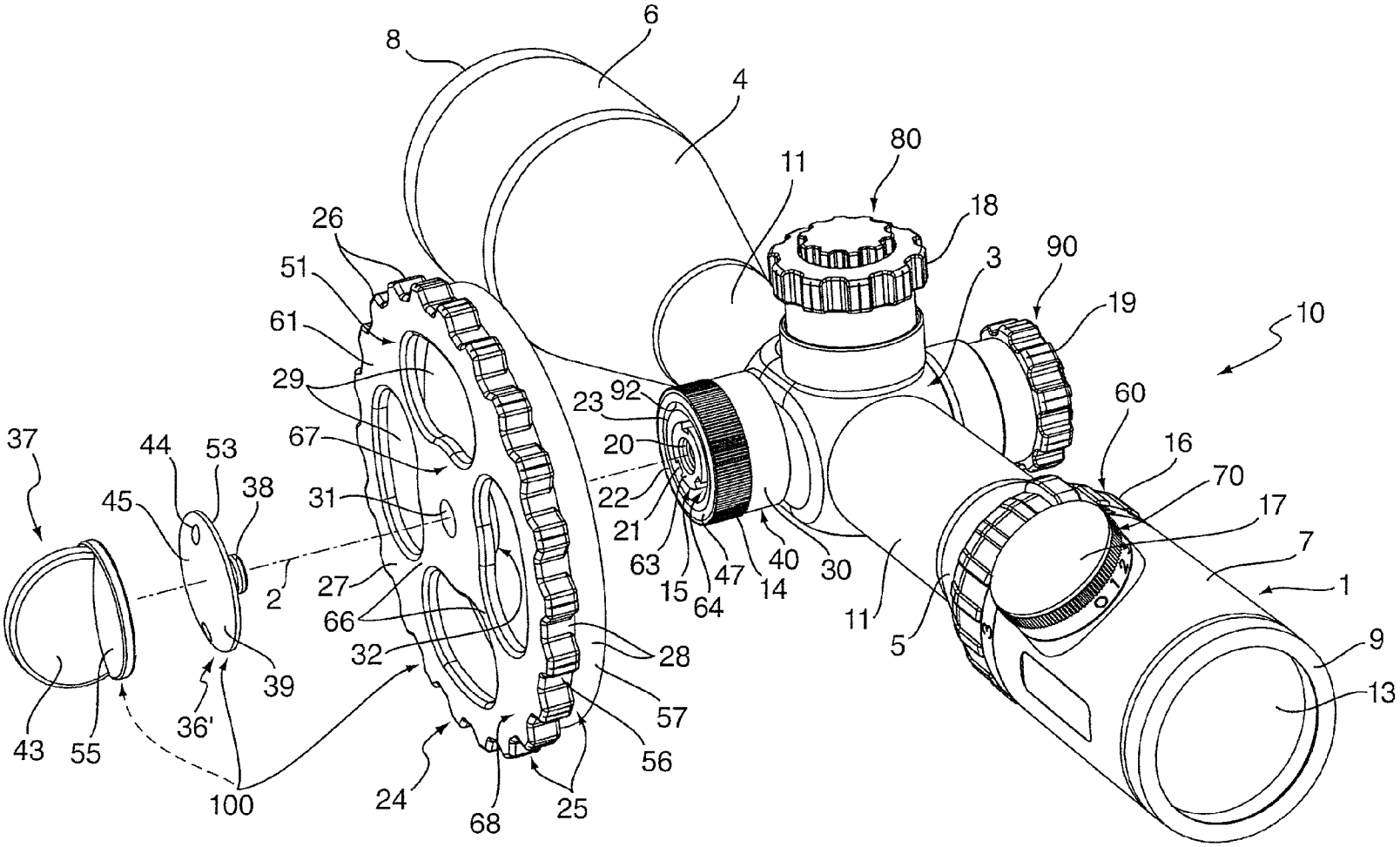
FIGS. 4 and 5 are a views of a rifle scope of FIG. 1 together with the component parts of a handwheel kit according to a preferred embodiment of the invention, which includes the cap bolt disassembled from the remainder of the focussing control, prior to fitting of the handwheel to the focussing control.
Figure 5:
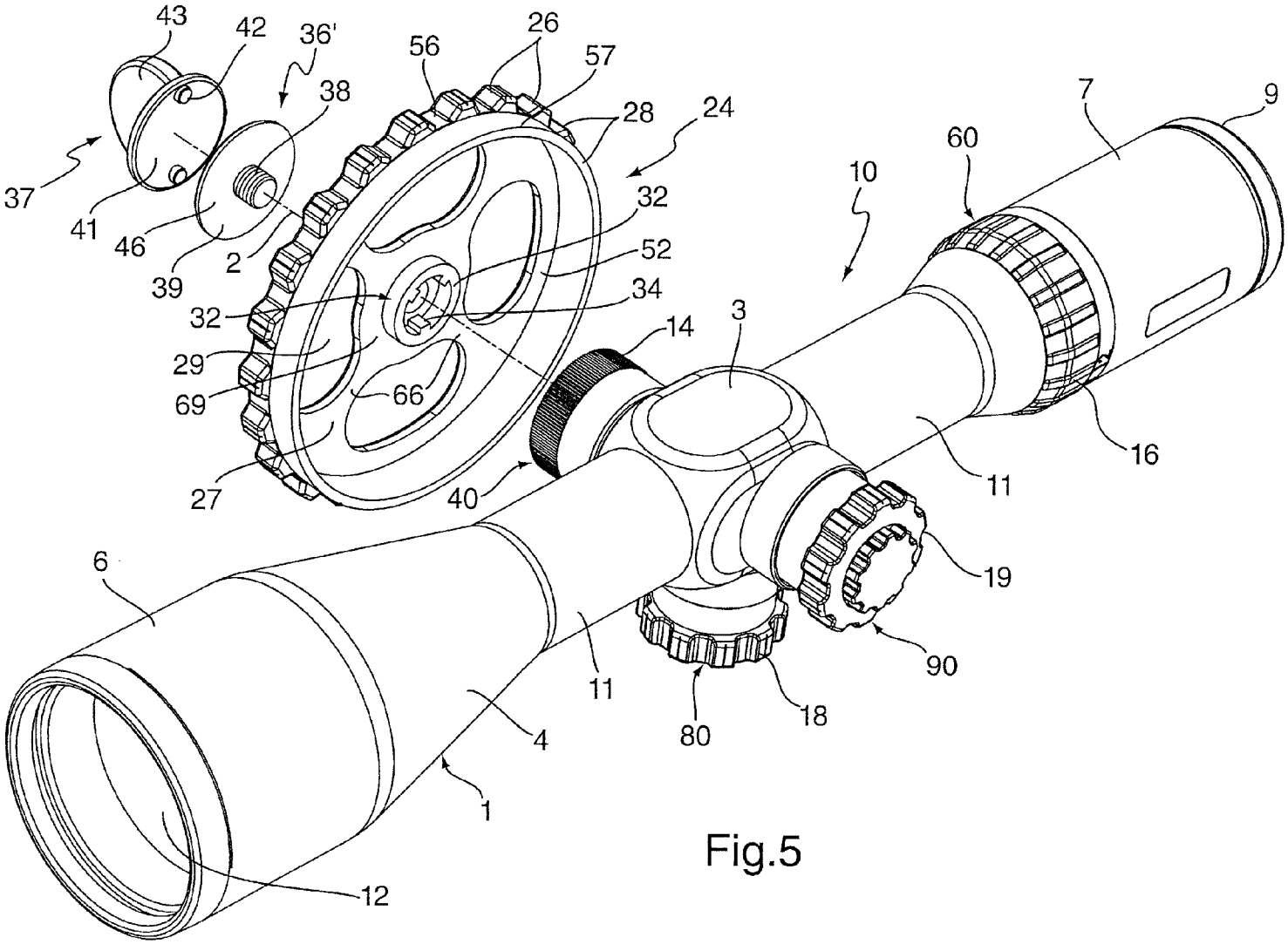
Figure 6:
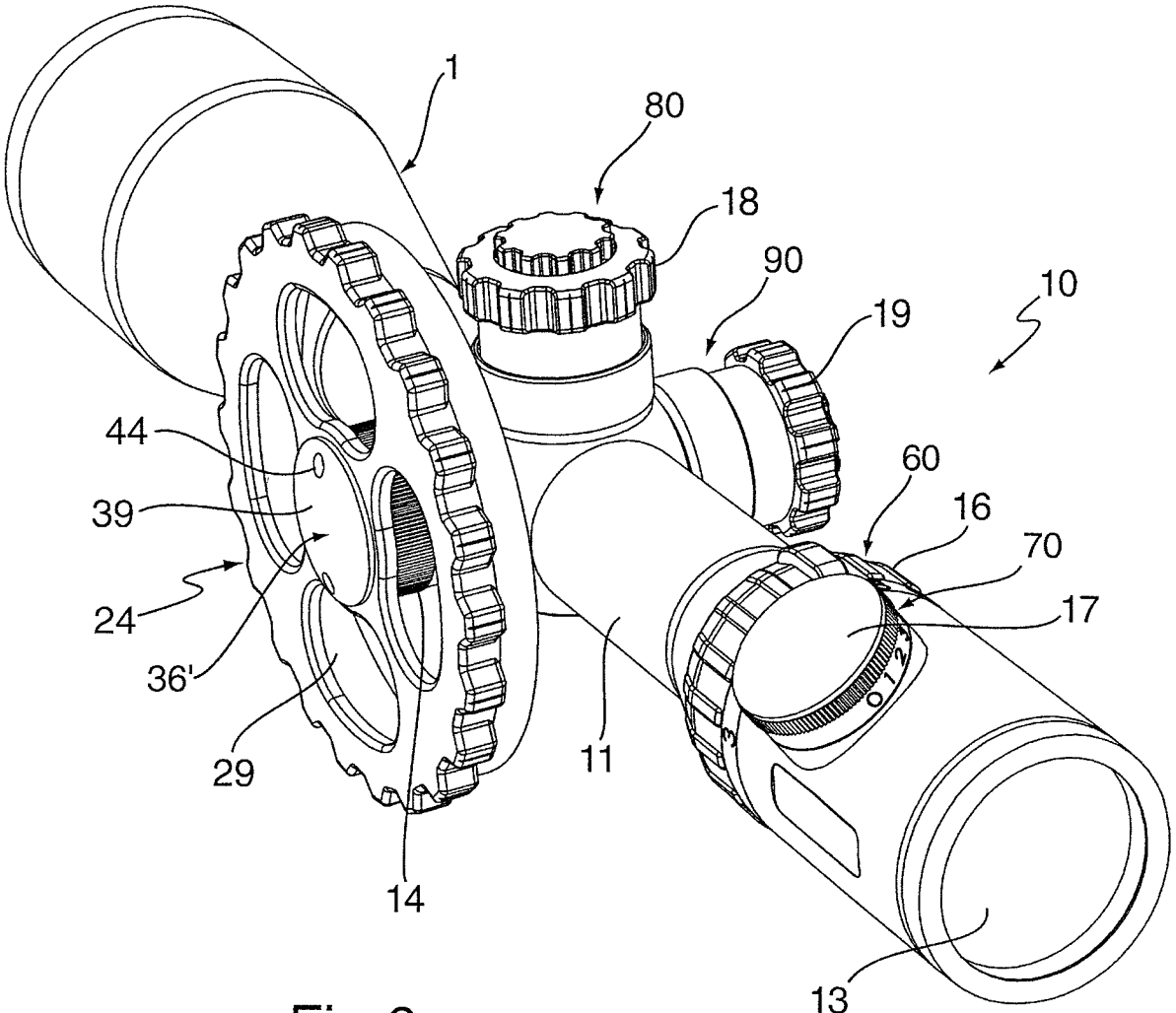
FIGS. 6 and 7 are views similar to those of FIGS. 4 and 5, after the handwheel kit has been fully fitted to the rifle scope to provide an enlarged focussing ring of the focussing control.
Figure 7:
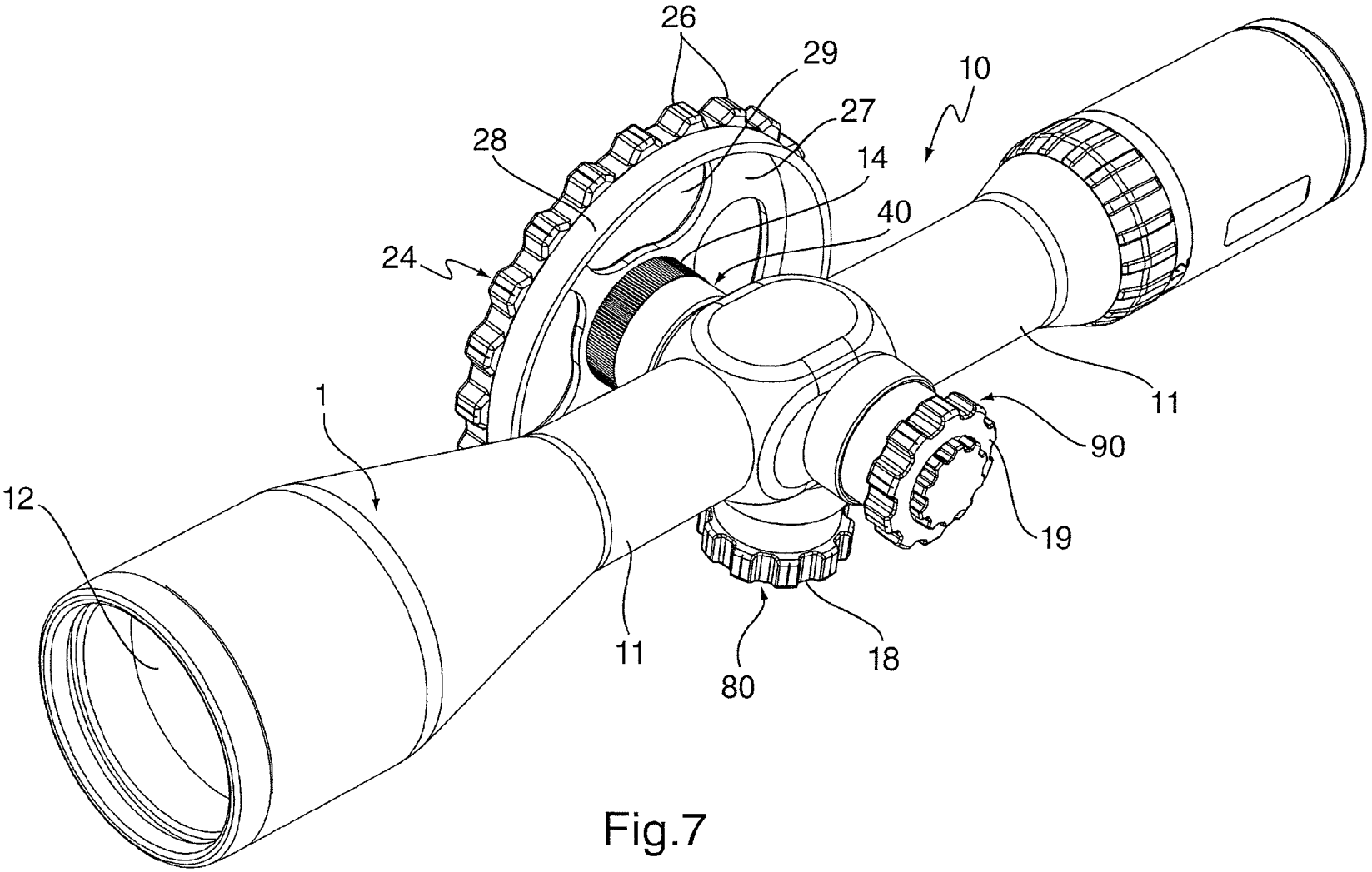
Figure 8:
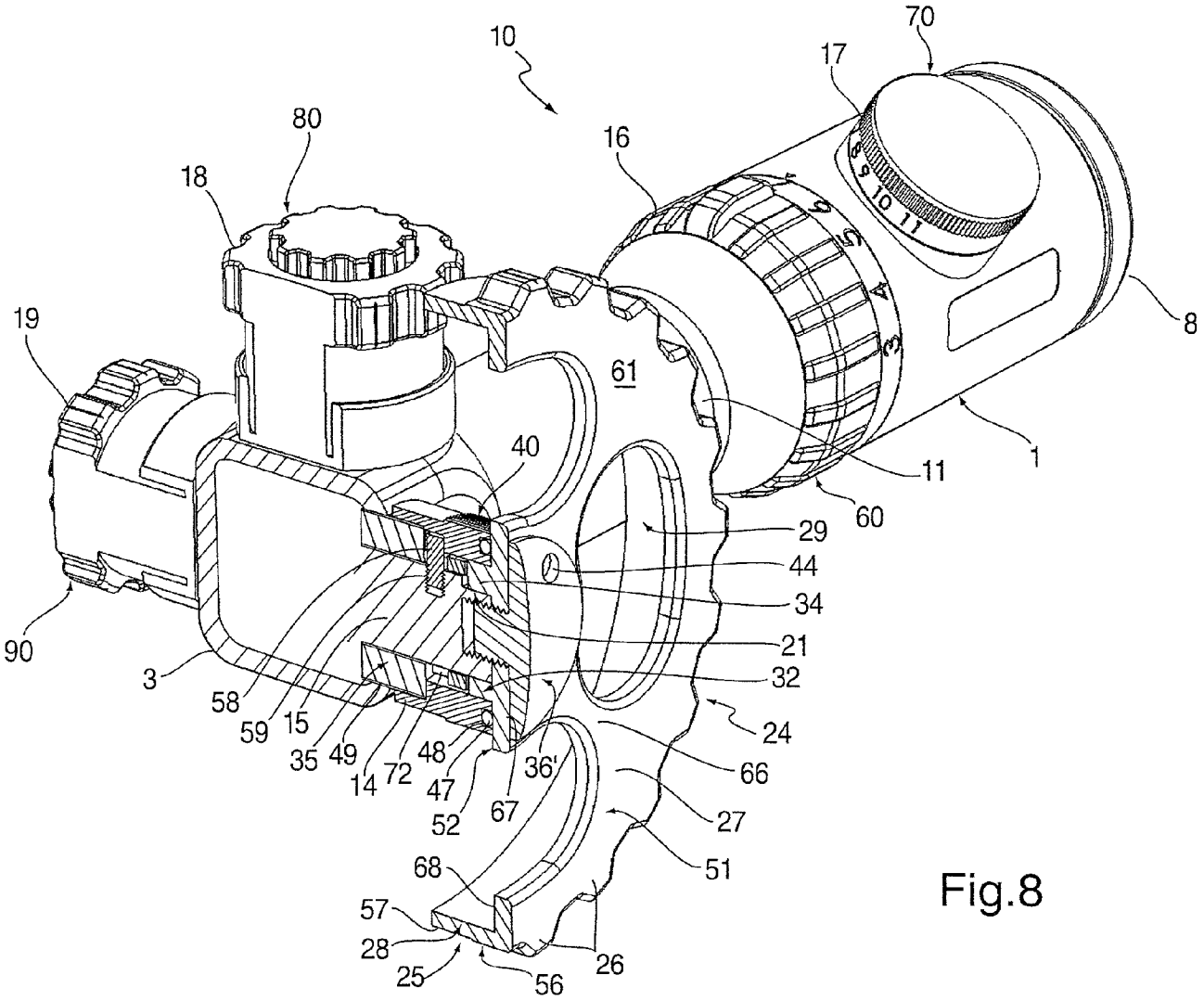
FIG. 8 is a cut through view similar to that of FIG. 3, after the handwheel kit has been fully fitted to the rifle scope.

The internal components of the sighting adjustment mechanisms within the main barrel 1 are entirely conventional and well-known to those skilled in the art, and so are not illustrated in the cut through views of FIGS. 3 and 8, or described in detail, but comprise components such as a movable reticle, the transverse position of which is adjustable by means of orthogonal sighting position adjustment controls 80 and 90. Both sighting position adjustment controls 80, 90 extend laterally from the central portion 11 of the main barrel 1 of the scope and comprise a corresponding adjustment ring 18, 19 to allow a position adjustment of the reticle to allow for the distance to the target, crosswinds and similar factors.

The sighting adjustment mechanisms also comprise a focussing adjustment control 40 that extends laterally from the central potion 11 of the main barrel 1 of the scope, for allowing an adjustment of components of a focussing mechanism within the main barrel 1. The internal components of the focussing mechanism are entirely conventional and well-known to those skilled in the art, and so are not illustrated in the cut through views of FIGS. 3 and 8, or described in detail, but comprise components such as a movable lens, the longitudinal position of which is adjustable by means of the focussing adjustment control 40 to effect focussing of an image provided to a user of the scope.

The focussing adjustment control 40 comprises a focussing knob or ring 14 that is rotatable about a rotation axis 2 to operate and control the internal components of the focussing mechanism incorporated within the main barrel. The focussing adjustment control 40 comprises a stub shaft 15 that projects laterally from the main barrel 1 of the scope, the stub shaft being connected to the internal focussing mechanism for effecting focussing of the scope. The focussing ring 14 is carried on a tubular cylindrical carrier 35 that surrounds an inner portion of the stub shaft and is rotationally fixed with respect to the stub shaft.

Also provided on the scope are a zoom adjustment control 60 and a reticle illumination control 70. The zoom adjustment control is coaxial with the main barrel 1 and the reticle illumination control extends laterally from the main barrel. The zoom adjustment control comprises a zoom control ring 16 on the second substantially cylindrical end portion 7 and the reticle illumination control comprises a reticle illumination control ring 17. The zoom adjustment control 60 and a reticle adjustment control 70 are both also conventional and well-known to those skilled in the art.

Figure 2:
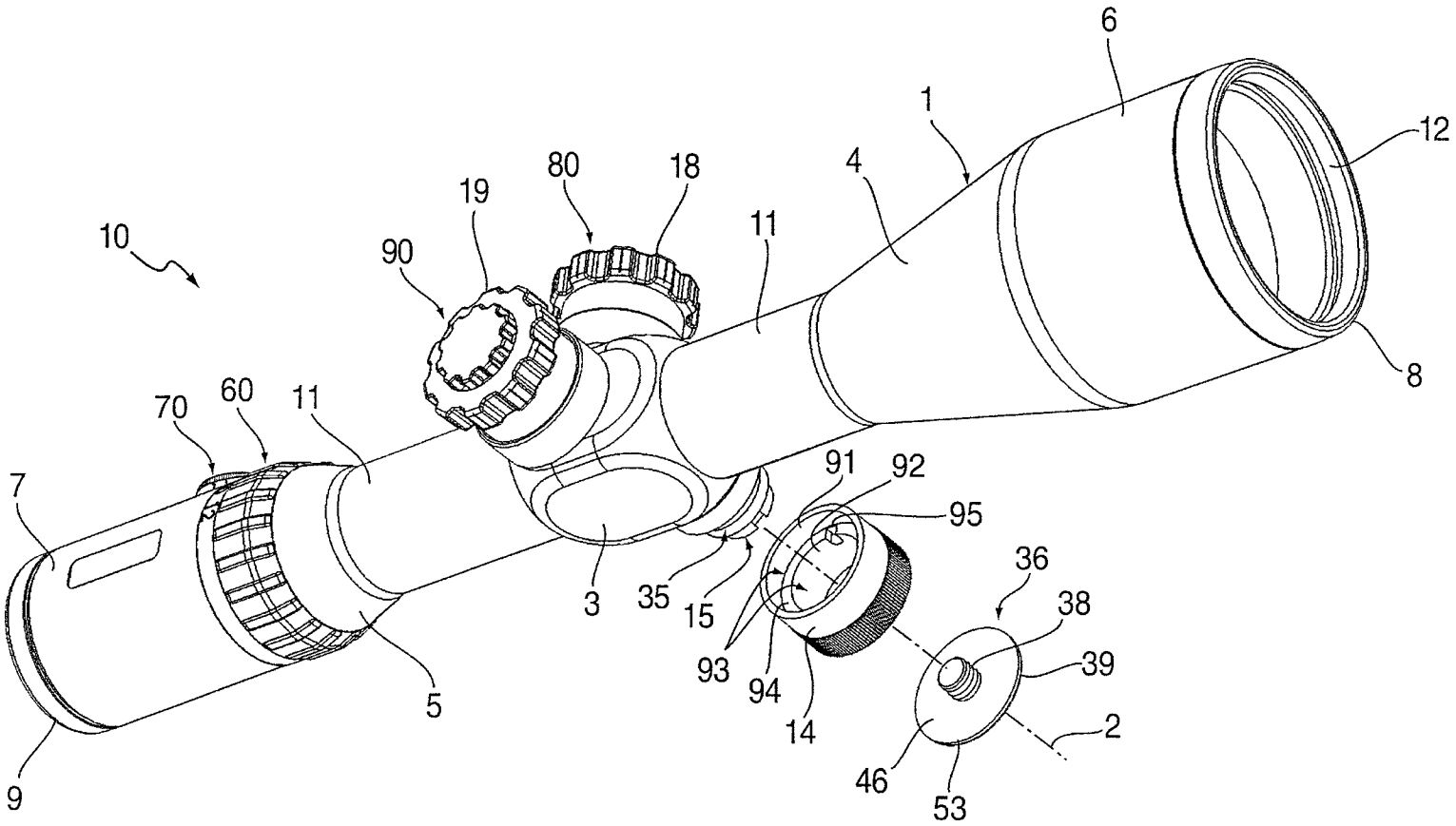

As shown in FIGS. 1 to 3, the tubular cylindrical carrier 35 is fixed to the rounded central portion 3 of the main barrel 1. The carrier 35 and main barrel central portion 3 may be a one-piece body, but in this example the carrier is permanently affixed to a mounting socket 49 in the central housing 3.

The carrier 35 has a stepped outer profile 73 having a first cylindrical surface 71 and a second cylindrical surface 72, the first cylindrical surface extending out from the mounting socket 49 and being a of larger diameter than the second cylindrical surface. An annular shoulder 74 extends between these first and second cylindrical surfaces 71, 72. The second cylindrical surface 72 terminates at an annular free end 75 of the tubular carrier 35.

A slot 50 in the second cylindrical surface 72 of the carrier directly adjacent the shoulder 74 extends in a circumferential direction over an angular extent somewhat more than 180° between opposite slot ends 76, 77. A blind pin 58 is threaded into a radially extending bore 59 in the stub shaft 15 such that the pin projects radially away from the rotation axis 2 of the stub shaft. This pin 58 is fitted to the stub shaft 15 through the slot 50 so that the stub shaft is retained in an axial direction to the carrier 35 but is free to rotate over 180° until the pin 58 contacts one or the other of the slot ends 76, 77.

As is best seen in FIG. 2, the focussing ring 14 is a sleeve having a stepped inner bore 93, provided by a first cylindrical surface 91 and a second cylindrical surface 92, this first cylindrical surface being a larger diameter than this second cylindrical surface. An annular shoulder 94 extends between these first and second cylindrical surfaces 91, 92. The shoulder is interrupted by a slot 95 in the second cylindrical surface, this slot extending in a direction parallel with the rotation axis 2 of the focussing ring.

The assembled carrier 35 and stub shaft 15 are received within the stepped inner bore 93 of the focussing ring, with the first cylindrical surface 91 of the focussing ring bore 93 making a close sliding fit over the first cylindrical surface 71 of the carrier outer profile 73. The pin 58 is received and held within the slot 95 in the second cylindrical surface 92 of the focussing ring bore 93, with the second cylindrical surface 92 of the focussing ring bore 93 making a close sliding fit over the second cylindrical surface 72 of the carrier outer profile 73.

The second cylindrical surface 72 of the carrier 35 extends in an axial direction a shorter extent than the second cylindrical surface 92 of the focussing ring bore 93. Also, the end surface 75 of the carrier is recessed relative to an end surface 63 of the stub shaft, both these end surfaces extending in a plane that is perpendicular to the rotation axis 2 of the focussing ring 14. This provides a substantially annular recess or bore 64 between the focussing ring 14 and the stub shaft 15. The carrier 35 therefore locates the sleeve of the focussing ring 14 with respect to the stub shaft to provide the annular recess or bore 64.

The focussing ring 14 has a free end 22 that extends in a plane that is perpendicular to the rotation axis 2 of the focussing ring 14. The free ends 22, 63 of the focussing ring 14 and stub shaft 15 may be co-planar with each other, however it is preferred if the free end 63 of the stub shaft is slightly recessed to ensure positive contact around the circumference of the free end 22 of the focussing ring with the headed bolt 36 that secures the focussing ring to the stub shaft. In this example, the headed bolt is referred to as a "cap bolt", because this has a head 39 of a diameter that is substantially the same as that of the focussing ring 14, so that the head 39 of the bolt provides a cap to the free end 22 of the focussing ring.

The stub shaft has a partly cylindrical outer surface 23 adjacent the free end 63 of the stub shaft, this surface being concentric with the rotation axis 2 and also having at least one recess 21. In this example, there are three such recesses, each one of which is an axially extending recess in the stub shaft, in this example a groove or keyway 21 that extends in a direction parallel to the rotation axis 2. Such a recess provides a non-cylindrical feature that may be engaged by a matching projection or abutment of a handwheel 24 so that the handwheel may turn the stub shaft, as will explained in more detail below. In this example, there are three keyways 21 extending parallel to the rotation axis 2, which is also an axis of the stub shaft 15.

As shown most clearly in the views of FIGS. 1 and 3, each of the keyways is a groove 21 with two square internal corners 33. The three keyways in the stub shaft 15 are initially empty, not being engaged by either the focussing ring 14 or the retaining cap bolt 36. As will be explained in more detail below with reference to FIGS. 4 to 8, the keyways 21 are used to engage the stub shaft with a focussing handwheel 24 after temporary removal of the cap bolt 36.

A threaded bore 20 is provided in the free end 63 of the stub shaft 15, concentric with the stub shaft axis 2. The cap bolt 36 has a threaded shaft or portion 38 that is engaged with the threaded bore 20 to hold the focussing ring 14 to the stub shaft. A pair of diametrically opposed driving holes 44 is formed in an outer surface 45 the cap bolt head 39. As will be explained in more detail below with relation to FIGS. 4 and 5, an operating key 37 engages with driving holes 44 to tighten and loosen the cap bolt 36.

To ensure the focussing ring 14 is secured to the stub shaft 15 in only one angular orientation with respect to the stub shaft, the orientation of the focussing ring with respect to the stub shaft is fixed by the pin 58 on the carrier engaging with the slot 95 inside the bore 93 of the focussing ring. This is to allow a distance scale (not shown) provided on one of the scope barrel 1 and the focussing ring 14 to be read against an index mark provided on the other of the scope barrel and focussing ring.

In addition, the keyways 21 of the shaft stub are not uniformly spaced around the circumference of the stub shaft. Typically, the distance between two keyways is significantly less than the distance between each of those keyways and the third keyway, that distance to the third keyway being the same for each of those two keyways. Thus, the keyways 21 are disposed at the apices of an isosceles triangle. As will be explained below, this gives the handwheel 24 affixed to the stub shaft 15 a unique orientation with respect to the stub shaft. This is also to allow a distance scale provided on one of the scope barrel and the handwheel to be read against an index mark provided on the other of the scope barrel and handwheel.

With a scope as described above, the focussing ring 14 is of a relatively small diameter and users often find it difficult accurately to adjust the focus of the scope. This problem is exacerbated when the scope is used in cold conditions and the user's fingers may be relatively insensitive and stiff. As a consequence, it is known to remove the relatively small focussing ring 14 and replace it with another component in the form of a wheel of a larger diameter than that of the focussing ring, or to provide such a wheel with a clamp arrangement, allowing the larger diameter wheel to be secured directly on an outer peripheral surface 30 of the focussing ring 14. However, in general those known arrangements have proved to be less than wholly satisfactory, as has been discussed above.

The preferred embodiment of this invention, as illustrated in FIGS. 4 to 8 avoids the necessity of removing the original focussing ring, and provides a relatively large diameter handwheel kit 100, comprising a handwheel 24 and a headed bolt, referred to in this description as a cap bolt 36'. In this example, the cap bolt 36' is the same cap bolt 36 described above as originally fitted in order to secure the focussing ring 14 to the scope 10. The kit may, however, comprise an additional cap bolt 36' which may optionally be different from that of the original cap bolt, for example having a different colour to match that of the handwheel, or may be functionally different, for example having a longer threaded shaft or portion 38 to accommodate the additional axial thickness of the handwheel. Both such possibilities are encompassed by the term "handwheel kit" as used herein.

The handwheel 24 is preferably substantially disc-shaped and has an outer periphery 25 that includes a plurality of peripheral indentations for assisting manual turning of the handwheel about a rotation axis of the handwheel, this rotational axis being the same as the rotation axis 2 of the focussing ring 24 when the handwheel is attached to the focussing ring. In this example the peripheral indentations are a succession of teeth 26 that facilitate turning of the handwheel, when fitted to the scope 10.

The handwheel 24 has on one axial side of the handwheel a plate-like main body which is referred to herein as a side cheek or a side plate 27. The side plate is preferably substantially circular in form. When the handwheel 24 is attached to the scope, the side plate extends radially outwards relative to the rotation axis 2 on the side of the handwheel that is further away in an axial direction from the main barrel 1 of the scope.

The side plate 27 has opposite first and second sides 51, 52. The first side 51 comprises a first surface 61, which is preferably planar, and the second side 52 comprises a second surface 62, which is also preferably planar. The planar surfaces 61, 62 of the first and second sides face in opposite axial directions relative to each other, such that the first surface 61 faces away from the scope 10 and the second planar surface 62 faces towards the scope when the handwheel 24 is fitted to the scope 10. Both the first and second planar surfaces 61, 62 are preferably parallel with each other such that the side plate 27 has a constant thickness between the first and second sides where the first and second planar surfaces 61, 62 are opposite one another.

Proximate the periphery 25 of the handwheel 24, the side plate 27 supports an outer rim 28, on part of which the teeth 26 are formed, and proximate a radially innermost portion of the handwheel, the side plate supports a hub 32. The outer rim 28 forms the periphery 25 of the handwheel 24.

Both the outer rim 28 and the hub 32 are substantially cylindrical and concentric with the axis 2, and both extend on the second side 52 of the side plate from 27 the second planar surface 62 in an axial direction towards the scope when the handwheel is fitted to the scope 10. The second side 52 of the side plate is shaped such that the second planar surface 62 extends between the outer rim 28 and the hub 32.

In this example, the teeth 26 project radially outwards on a portion 56 of the of the outer rim 28 extends in an axial direction fully over the side plate and over a part of the outer rim 28 that is nearer to the side plate 27. The remainder of the outer rim 28 further from the side plate 27 preferably has a cylindrical outer surface 57. In this example, the teeth therefore extend over a part of the total axial width of the outer rim 28. In an alternative embodiment not illustrated in the drawings, the teeth 26 may be extended in an axial direction to cover a greater extent, or the full axial extent, of the outer rim 28.

The side plate 27 itself is preferably a perforated plate provided with one or more openings 29 sized for engagement with a user's finger. In this example there are four relatively large openings 29, each of which is in this example is relatively large as compared with a finger tip. The openings may, however, be smaller than this as long as the openings are sized to accommodate a finger of a user, again to facilitate turning of the handwheel 24 when fitted to a scope 10. Between the four openings 29 are four spokes 66 that extend from an inner annular portion 67 of the side plate to an outer annular portion 68 of the side plate. The inner annular portion of the side plate provides a planar annular section 69 of the second surface 62 surrounding the hub 32 for covering the free end 22 of the focussing ring 14 when the handwheel is secured to the stub shaft by the cap bolt 36'. Preferably, the free end 22 of the focussing ring 14 comes into contact with the planar annular surface 69 around the hub when the handwheel is fitted to the scope, to help prevent ingress of dirt and moisture into the inner workings of the focussing control 40. To this end, the focussing control preferably includes a sealing O-ring 47 seated in an annular groove 48 in the end face 22 of the focussing ring 14. This O-ring 47 also provides a seal with an inner face 46 cap bolt 36 prior to removal of the cap bolt from the focussing ring to allow fitting of the handwheel to the scope.

A central hole 31 is formed in the side plate 27. The hole 31 extends in an axial direction from the first side 51 and is coaxial with the hub 32 such that the hole leads to a bore 65 inside the hub 32. The hub 32 preferably extends away from the second surface 52 of the side plate in an axial direction less than does the rim 28 such that the hub lies within the axial depth of the rim 28. The hub 32 is therefore formed on the second surface 52 of the side plate 27, coaxial with the hole 31.

The hub 32 has a cylindrical external surface 54, coaxial with the axis 2 which is a close sliding fit within the outermost second cylindrical surface 92 of the focussing ring 14 in the annular bore 64 between the stub shaft 15 and the focussing ring. Preferably, the external surface 54 of the hub is smooth.

The fit of the stub shaft 15 within the bore 65 of the hub 32 of the focussing ring 14 helps to ensures an accurate location of the handwheel 24 to the focussing ring 14. Internally, the bore 65 of the hub 32 is a close sliding fit on the outer surface 23 of the stub shaft 15, the bore of the hub 65 having three inwardly projecting ribs 34 disposed in the same configuration as the keyways 21 in the outer surface 23 of the stub shaft 15. The hub therefore has at least one abutment 34 for co-operation with at least one corresponding recess 21 in the stub shaft 15 to inhibit relative rotational movement between the hub and hand wheel.

In this way, the handwheel 24 may be fitted to the stub shaft to provide an enlarged focussing ring on the original focussing ring 14. In this example, the enlarged focussing ring is provided by the outer rim 28 of the handwheel, particularly the peripheral indentations and teeth 26 and the cylindrical outer surface 57 of the outer rim, either of which a user can conveniently grip and turn.

The enlarged focussing ring 28 provided by the handwheel is accurately located coaxially with the original focussing ring 14, in a non-rotatable manner with respect to the stub shaft such that rotation of the handwheel 24 about the rotational axis 2 causes rotation of the stub shaft 15 and focussing ring 14 in order to adjust the focus of the scope 10.

The cap bolt 36' may be provided with a feature such as a straight slot for a slotted screwdriver, or a cross-head recess for a cross-head screwdriver. In this example, the cap bolt is tightened and loosened by an operating key 37, which therefore forms an optional component of the handwheel kit 100, as indicated by the dashed line in FIG. 4. The threaded shaft 38 of the cap bolt 36' is sized to pass through the central hole 31 in the side plate of the handwheel for engagement with the threaded bore 20 of the stub shaft 15.

In this example, the depth of the bore 20 in the stub shaft 15, the length of the threaded portion 38 of the cap bolt 36', and the thickness of the side plate 27, are all such that the same cap bolt 36, 36' may be used both with and without the handwheel being attached to the focussing control 40. This is a particular benefit, because even if a spare cap bolt is provided to a user with each handwheel kit, the user does not have to keep a spare cap bolt with the rifle scope when attaching or removing the handwheel to the scope.

The diameter of the head 39 of the cap bolt 36' is large as compared with the diameter of the central hole 31. Preferably, the thickness of the head 39 is very small such that when fitted to the handwheel and stub shaft, the head projects only to a small extent beyond the side plate 27. As shown, an outer exposed surface 45 of the cap bolt head 39 may be spherically domed to a small extent for aesthetic reasons and to minimise the thickness of an outer circular edge 53 to reduce the chance of objects catching on the edge 53. The thickness of the cap bolt is sufficient to give enough strength to the cap bolt such that the cap bolt will retain the handwheel once engaged with the focussing ring 14. The inner surface 46 of the cap bolt head 39 is preferably planar, for engagement with the planar first surface 61 of the side plate 27.

As mentioned above, a pair of diametrically opposed driving holes 44 is formed in the outer surface 45 of the cap bolt head 39, each of these heads extending parallel with the bolt axis 2, to allow rotation of the cap bolt 36' about the axis by means of the operating key 37. The operating key has an inner driving face 41 that is spherically concave with the same radius of curvature as that of the spherically convex outer surface 45 of the cap bolt head 39 so as to fit closely against the outer surface of the cap bolt head. The operating key 37 also has a pair of pegs 42 disposed for engagement in the driving holes 44 of the cap bolt head 39. The operating key 37 has a spherically convex outer face 55 that is concentric with the inner surface 41 of the cap bolt head. Projecting outwards in an axial direction from the outer face 55 of the operating key is a finger tab 43 to allow easy manipulation of the operating key, for tightening or loosening of the cap bolt 36'.

The components of the handwheel kit 100 may be formed from plastic material, for example glass-reinforced plastic, or from metal, for example anodised aluminium. The handwheel 24 is preferably a one-piece component, rather than being formed from separable parts. The diameter of the handwheel is relatively large as compared with that of the focussing ring 14, and is larger than the largest diameter of any part of the main barrel 1 of the scope 10. In this example, the scope is 100 mm long, the diameter of the first substantially cylindrical end portion 6 that supports the objective lens 12 is 62 mm, the diameter of the focussing ring 14 is 30 mm and the diameter of the handwheel, including indentations 26, is 100 mm. The handwheel may, in principle have any diameter in excess of that of the focussing ring 14 but will typically have a diameter of between 50 mm and 150 mm.

Once attached, the outer periphery of the handwheel 24 provides an enlarged focussing ring for the focussing control 40. The handwheel kit 100 described above is used in conjunction with the scope 10 to give a much better and more accurate focussing operation than can often be obtained with the focussing ring 14 provided with the scope. In order to fit the handwheel to an existing scope having only a focussing ring, the headed bolt 36 is released from the stub shaft 15. Then, the handwheel is offered to the stub shaft and turned until the three ribs 34 within the hub 32 are aligned with the keyways 21 in the stub shaft 15 and then the handwheel is pushed axially, fully to engage with the stub shaft and have the outer circumferential surface 21 of the hub locate within the focussing ring 14. The cap bolt 36' is then fitted to the handwheel and stub shaft and is tightened to the required extent by using the key 37, such that the inner face 69 of the side plate 27 bears on the end surfaces 22, 47 of the focussing ring 14. Depending upon the design of the existing scope, it may be possible to re-use the headed bolt associated with the focussing ring, as the cap bolt 36' for retaining the handwheel to the stub shaft. However, such a headed bolt may not be suitable for this purpose: the head may be of an insufficient diameter securely to hold the handwheel in position; the threaded portion of the headed bolt may be insufficiently long on account of the thickness of the side plate of the handwheel; and the head of the original headed bolt may be less pleasing, aesthetically, as compared to the relatively thin head of the cap bolt 36'.

In practice, it is found that with some designs of rifle scope 10, the handwheel kit 100 described above allows for adjustment of the friction associated with the stub shaft 15 for effecting focussing of the scope. Thus, by increasing the torque applied to the cap bolt 36', the friction may also be increased, but without necessarily increasing static friction. This can be advantageous when using the rifle scope with the handwheel kit fitted, in adverse conditions or where the handwheel might be accidentally nudged following initial adjustment.

It is to be recognized that various alterations, modifications, and/or additions may be introduced into the constructions and arrangements of parts described above without departing from the spirit or scope of the present invention, as defined by the appended claims.

The invention claimed is:

1. A focussing handwheel kit for enlarging a focussing ring of a rifle scope, said kit comprising a handwheel for fitting to a stub shaft of said focussing ring and a cap bolt for securing the handwheel to said stub shaft, in which the handwheel comprises:

an outer rim having an outer periphery for providing said enlarged focussing ring, the outer periphery of the outer rim comprising a plurality of peripheral indentations for assisting manual turning of the handwheel about a rotational axis of the handwheel when the handwheel is fitted to said focussing ring;

a side plate, the side plate supporting the outer rim and extending radially inwards from the outer rim towards a central hole in the side plate, the side plate having opposite first and second sides; and a hub, the hub projecting axially away from the second side of the side plate to present a bore within the hub for receiving said stub shaft, said hole extending to said bore and the hub being concentric with said hole about said rotational axis;

wherein the cap bolt has a head and a threaded portion, the threaded portion being configured to extend through said hole such that said threaded portion, in use, screws into a threaded bore of said stub shaft received in said hub, and the head being configured to bear on the first side of the side plate opposed to the hub when the threaded portion of the cap bolt is screwed into said threaded bore to secure the handwheel to said stub shaft, and the hub has at least one abutment in the bore within the hub for co-operation with said stub shaft to inhibit relative rotational movement between the handwheel and said stub shaft when the handwheel is secured to said stub shaft by the cap bolt, and wherein the second side of the side plate has an annular planar portion surrounding the hub for covering a free end of said focussing ring when the handwheel is secured to said stub shaft by the cap bolt.

2. A focussing handwheel kit as claimed in claim 1, in which said abutment comprises a projection extending radially inwardly of the hub for engagement with a corresponding recess in said stub shaft.

3. A focussing handwheel kit as claimed in claim 2, in which the hub has a circular wall concentric with the central hole in the side plate and said abutment comprises a key on the circular wall for engagement in a corresponding keyway in said stub shaft.

4. A focussing handwheel kit as claimed in claim 2, in which there are two of said abutments, said abutments being provided by two corresponding projections arranged non-symmetrically relative to a circumference of the hub whereby the handwheel may be fitted to said stub shaft in only one rotational angular orientation.

5. A focussing handwheel kit as claimed in claim 2, in which there are three of said abutments, said abutments being provided by three corresponding projections arranged with unequal spacings therebetween relative to a circumference of the hub whereby the handwheel may be fitted to said stub shaft in only one rotational angular orientation.

6. A focussing handwheel kit as claimed in claim 1, in which the hub has an outer surface that extends in an axial direction so that, in use, the outer surface of the hub is configured to slidingly engage with an axially extending inner surface of a bore in said focussing ring surrounding said stub shaft.

7. A focussing handwheel kit as claimed in claim 1, in which said kit further comprises an operating key and the head of the cap bolt has a circular periphery, the head of the cap bolt having a thickness in an axial direction that is less than a diameter of said circular periphery, the head of the cap bolt having openings for engagement by corresponding projections on the operating key, whereby, in use, the projections on the operating key are engaged with the openings in the head of the cap bolt to rotate the cap bolt about said axis to screw the threaded portion of the cap bolt into said threaded bore.

8. A focussing handwheel kit as claimed in claim 7, in which the openings are formed in an outer end face of the cap bolt head and extend parallel to an axis of the threaded portion of the cap bolt.

9. A focussing handwheel kit as claimed in claim 1, in which the outer rim of the handwheel is disposed wholly to the second side of the side plate such that the outer rim overlies the hub.

10. A focussing handwheel kit as claimed in claim 1, in which the peripheral indentations of the outer rim provide a series of equally spaced teeth around the outer periphery of the outer rim.

11. A focussing handwheel kit as claimed in claim 1, in which the side plate has a plurality of openings for facilitating turning of the handwheel when the handwheel is fitted to a rifle scope.

12. A focussing handwheel for fitting to a stub shaft of a focussing ring of a rifle scope to provide an enlarged focussing ring for the rifle scope, the handwheel comprising:

an outer rim having an outer periphery for providing said enlarged focussing ring, the outer periphery of the outer rim comprising a plurality of peripheral indentations for assisting manual turning of the handwheel about a rotational axis of the handwheel when the handwheel is fitted to said focussing ring;

a side plate, the side plate supporting the outer rim and extending radially inwards from the outer rim towards a central hole in the side plate, the side plate having opposite first and second sides; and a hub, the hub projecting axially away from the second side of the side plate to present a bore within the hub for receiving said stub shaft, said hole extending to said bore within the hub and the hub being concentric with said hole about said rotational axis;

wherein said hole leads to said bore within the hub to allow a threaded shaft of a cap bolt to pass through said hole and into said bore for engagement with a threaded bore in said stub shaft and the hub has at least one abutment in the bore within the hub for co-operation with said stub shaft to inhibit relative rotational movement between the handwheel and said stub shaft when the handwheel is secured to said stub shaft by the cap bolt, and wherein the second side of the side plate has an annular planar portion surrounding the hub for covering a free end of said focussing ring when the handwheel is secured to said stub shaft by the cap bolt.

13. A method of enlarging the focussing ring of a focussing control of a rifle scope using a focussing handwheel comprising a periphery larger than that of said focussing ring, a side plate with a central hole, the central hole extending to a hub having a hub bore, and the focussing control having: a focussing ring that is manually accessible on said side of the scope, said focussing ring having a rotation axis for adjusting the focus of the scope; a stub shaft within the focussing ring, the stub shaft being rotationally fixed with respect to the focussing ring such a rotation of the focussing ring causes a corresponding rotation of the stub shaft, and the stub shaft having in a free end of the stub shaft a threaded axial bore; and a headed bolt with a head and a threaded bore removably engaged with said threaded bore such that a head of the cap bolt retains the focussing ring, wherein the method comprises:

removing the headed bolt from the stub shaft;

with the focussing ring in place, fitting the handwheel to the rifle scope by engaging a bore in a hub of the handwheel with a free end portion of the stub shaft;

passing the threaded portion of a cap bolt through the central hole in the side plate and engaging the threaded portion with the threaded bore in the stub shaft; and tightening the cap bolt sufficiently to engage the side plate with the focussing ring thereby holding the focussing handwheel to the rifle scope such that the periphery of the focussing handwheel provides an enlarged focussing ring for a user of the rifle scope.

14. A method as claimed in claim 13, in which the method comprises the step of reusing the headed bolt removed from the threaded bore as the cap bolt subsequently used to hold the focussing handwheel to the rifle scope.

15. A method as claimed in claim 13 , in which the hub has at least one abutment in the bore within the hub and the stub shaft has at least one recess corresponding with said at least abutment, and the method comprises the step of engaging said abutment with said recess when the free end portion of the stub shaft is engaged in the bore of the hub to inhibit relative rotational movement between the focussing handwheel and the stub shaft.

* * * * *